US008780002B2

(12) United States Patent
Håkansson et al.

(10) Patent No.: US 8,780,002 B2
(45) Date of Patent: Jul. 15, 2014

(54) MULTIPLE-INPUT MULTIPLE-OUTPUT (MIMO) MULTI-BAND ANTENNAS WITH A CONDUCTIVE NEUTRALIZATION LINE FOR SIGNAL DECOUPLING

(75) Inventors: Mikael Håkansson, Skåne (SE); Zhinong Ying, Skåne (SE)

(73) Assignees: Sony Corporation, Tokyo (JP); Sony Mobile Communications AB, Lund (SE)

( * ) Notice: Subject to any disclaimer, the term of this patent is extended or adjusted under 35 U.S.C. 154(b) by 382 days.

(21) Appl. No.: 12/837,018

(22) Filed: Jul. 15, 2010

(65) Prior Publication Data

US 2012/0013519 A1 Jan. 19, 2012

(51) Int. Cl.
*H01Q 21/00* (2006.01)

(52) U.S. Cl.
USPC ..... 343/835; 343/700 MS; 343/834; 343/836; 343/837; 343/893

(58) Field of Classification Search
CPC ..... H01Q 1/521; H01Q 1/38; H01Q 21/28; H01Q 1/243; H01Q 1/36
USPC ..... 343/700 MS
See application file for complete search history.

(56) References Cited

U.S. PATENT DOCUMENTS

| | | | | |
|---|---|---|---|---|
| 7,355,559 | B2 * | 4/2008 | Tikhov et al. | 343/895 |
| 7,586,445 | B2 * | 9/2009 | Qin et al. | 343/700 MS |
| 7,724,201 | B2 * | 5/2010 | Nysen et al. | 343/821 |
| 8,130,162 | B2 * | 3/2012 | Kildal | 343/792.5 |
| 2008/0246689 | A1 | 10/2008 | Qin et al. | |
| 2009/0058735 | A1 * | 3/2009 | Hill et al. | 343/702 |
| 2009/0174557 | A1 | 7/2009 | Nikitin et al. | |
| 2010/0001907 | A1 * | 1/2010 | Wan | 343/700 MS |
| 2010/0225553 | A1 * | 9/2010 | Minard et al. | 343/770 |
| 2011/0221648 | A1 * | 9/2011 | Lee et al. | 343/826 |
| 2011/0298666 | A1 * | 12/2011 | Kim et al. | 343/700 MS |

FOREIGN PATENT DOCUMENTS

| | | | |
|---|---|---|---|
| EP | 2 360 787 | A2 | 8/2011 |
| WO | WO 00/01030 | A1 | 1/2000 |
| WO | WO 03077360 | A1 | 9/2003 |

OTHER PUBLICATIONS

Diallo A. et al., "Enhanced two-antenna structures for universal mobile telecommunications system diversity terminals", *IET Micorw. Antennas Propag.*, 2008, vol. 2, Issue 1, pp. 93-101.
European Search Report Corresponding to European Patent Application No. 11169721.5; Dated: Dec. 6, 2012; 17 Pages.

(Continued)

*Primary Examiner* — Jacob Y Choi
*Assistant Examiner* — Jae Kim
(74) *Attorney, Agent, or Firm* — Myers Bigel Sibley & Sajovec, PA

(57) ABSTRACT

A MIMO antenna includes first and second radiating elements and a conductive neutralization line. Each of the first and second radiating elements includes a straight portion connected to a serpentine portion. The straight and serpentine portions are configured to resonate in at least two spaced apart RF frequency ranges in response to the straight portion being electrically excited through a RF feed. The conductive neutralization line conducts resonant currents between the first and second radiating elements and has a conductive length that is configured to phase shift the conducted resonant currents to cause at least partial cancellation of currents in the first and second radiating elements which are generated by wireless RF signals received by the first and second radiating elements from each other.

19 Claims, 4 Drawing Sheets

(56) References Cited

OTHER PUBLICATIONS

Park Y. et al., "Multi-band diversity antenna for mobile handset applications", *Antennas and Propagation Society, International Symposium* (*APSURSI*), *IEEE*, Jul. 11, 2010, 4 pages.

European Office Action Corresponding to European Patent Application No. 11 169 721.5; Date Mailed: Nov. 27, 2013; 5 Pages.

* cited by examiner

MULTIPLE-INPUT MULTIPLE-OUTPUT (MIMO) MULTI-BAND ANTENNAS WITH A CONDUCTIVE NEUTRALIZATION LINE FOR SIGNAL DECOUPLING

FIELD OF THE INVENTION

The present application relates generally to communication devices, and more particularly to, multiple-input multiple-output (MIMO) antennas and wireless communication devices using MIMO antennas.

BACKGROUND

Wireless communication devices, such as WIFI 802.11N and LTE compliant communication devices, are increasingly using MIMO antenna technology to provide increased data communication rates with decreased error rates. A MIMO antenna includes at least two antenna elements. The operational performance of a MIMO antenna depends upon obtaining sufficient decoupling and decorrelation between its antenna elements. It is therefore usually desirable to position the antenna elements far apart within a device and/or to use radiofrequency (RF) shielding therebetween while balancing its size and other design constraints.

SUMMARY

In some embodiments of the present invention, a MIMO antenna includes first and second radiating elements and a conductive neutralization line. Each of the first and second radiating elements includes a straight portion connected to a serpentine portion. The straight and serpentine portions are configured to resonate in at least two spaced apart RF frequency ranges in response to the straight portion being electrically excited through a RF feed. The conductive neutralization line connects the first and second radiating elements to conduct resonant currents therebetween that at least partially cancel RF transmission coupling between the first and second radiating elements.

In some further embodiments, the straight portions of the first and second radiating elements can have an equal conductive path length, and the serpentine portions of the first and second radiating elements can have an equal conductive path length.

The straight and serpentine portions of the second radiating element can be configured as a mirror image of the straight and serpentine portions of the first radiating element.

A conductive path length of the conductive neutralization line can be configured to phase shift the conducted resonant currents to cause at least partial cancellation of RF signals wirelessly received by the first and second radiating elements from each other. The location where the conductive neutralization line connects to the first and second radiating elements and the conductive path length of the conductive neutralization line can be configured to phase shift the resonant current conducted from the first radiating element to the second radiating element to cause its subtraction from a current induced by a wireless RF signal received by the second radiating element from the first radiating element, and configured to phase shift the resonant current conducted from the second radiating element to the first radiating element to cause its subtraction from a current induced by a wireless RF signal received by the first radiating element from the second radiating element.

The first and second radiating elements can be spaced apart by less than the combined conductive lengths of the straight and serpentine portions of the first radiating element, such as spaced apart by less than the conductive length of the straight portion of the first radiating element.

The first radiating element can be configured to resonate within a lower RF frequency range defined by a combined conductive length of its straight and serpentine portions, and to resonate within a higher RF frequency range defined by a conductive length of its straight portion.

The first and second radiating elements can be configured to resonate within higher and lower RF frequency ranges. The higher frequency range can include a frequency at least twice as great as frequencies within the lower RF frequency range. The higher frequency range can include 5.2 GHz and the lower frequency range can include 2.4 GHz.

The conductive neutralization line can have at least two abrupt opposite direction changes along its conductive path between the first and second radiating elements to decrease distance between the first and second radiating elements.

A conductive length of the serpentine portion of each of the first and second radiating elements can be at least four time greater than a respective conductive length of the straight portion of the first and second radiating elements.

The first and second radiating elements can each include an inductive load element that is connected to a distal end of the serpentine portion from an end connected to the straight portion.

The MIMO antenna can further include a first parasitic radiating element that is adjacent and capactively coupled to the first radiating element to radiate responsive to the first radiating element resonating at a RF frequency, and a second parasitic radiating element that is adjacent and capactively coupled to the second radiating element to radiate responsive to the second radiating element resonating at a RF frequency.

The linear portions of the first and second radiating elements can lie in a plane that is perpendicular to another plane in which the serpentine portions of the first and second radiating elements lie.

The linear and serpentine portions of the first and second radiating elements can be on a planar dielectric substrate.

The MIMO antenna can further include third and fourth radiating elements, each of which include a straight portion connected to a serpentine portion. The straight and serpentine portions are configured to resonate within at least two spaced apart RF frequency ranges in response to the straight portion being electrically excited through a third RF feed. Another conductive neutralization line can connect the third and fourth radiating elements and further connect to the other conductive neutralization line to at least partially cancel RF transmission coupling between the first, second, third, and fourth radiating elements. The linear portions of the first, second, third, and fourth radiating elements can lie in a plane that is perpendicular to another plane in which the serpentine portions of the first, second, third, and fourth radiating elements lie.

Some other embodiments of the present invention are directed to a MIMO antenna that includes first and second radiating elements, a conductive neutralization line, and first and second parasitic radiating elements. Each of the first and second radiating elements includes a straight portion connected to a serpentine portion. The straight and serpentine portions are configured to resonate in at least two spaced apart RF frequency ranges in response to the straight portion being electrically excited through a RF feed. The conductive neutralization line conducts resonant currents between the first and second radiating elements and has a conductive length that is configured to phase shift the conducted resonant currents to cause at least partial cancellation of currents in the first and second radiating elements which are generated by wireless RF signals received by the first and second radiating element from each other. The first parasitic radiating element is adjacent and parasitically coupled to the first radiating element to radiate responsive to the first radiating element resonating at a RF frequency. The second parasitic radiating element is adjacent and parasitically coupled to the second radiating element to radiate responsive to the second radiating element resonating at a RF frequency.

Other antennas, communications devices, and/or methods according to embodiments of the invention will be or become apparent to one with skill in the art upon review of the following drawings and detailed description. It is intended that all such additional antennas, communications devices, and/or methods be included within this description, be within the scope of the present invention, and be protected by the accompanying claims. Moreover, it is intended that all embodiments disclosed herein can be implemented separately or combined in any way and/or combination.

BRIEF DESCRIPTION OF THE DRAWINGS

The accompanying drawings, which are included to provide a further understanding of the invention and are incorporated in and constitute a part of this application, illustrate certain embodiment(s) of the invention. In the drawings.

DETAILED DESCRIPTION OF EMBODIMENTS

Figure 1:
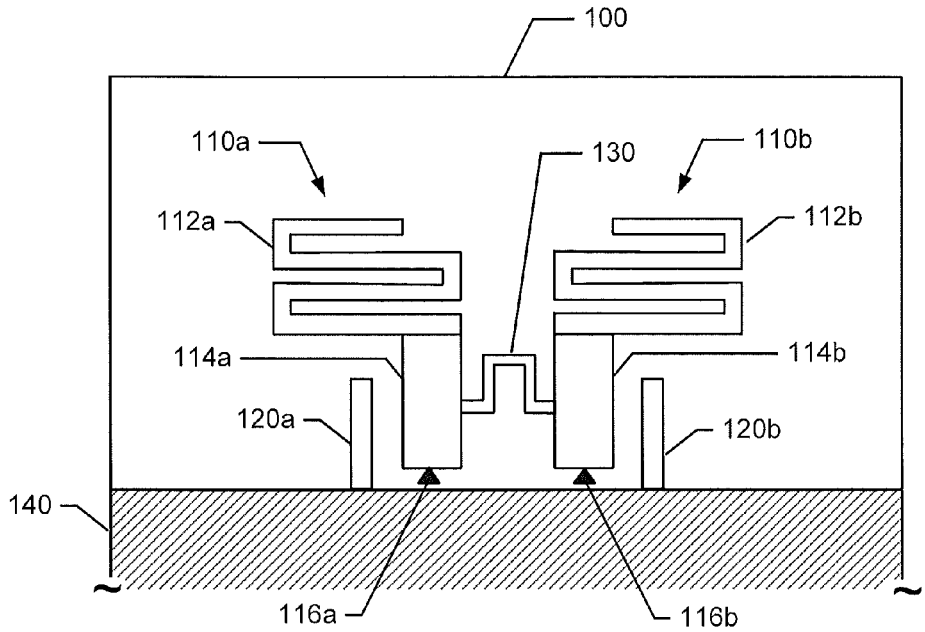
FIG. 1 is a plan view of a partial printed circuit board that includes a MIMO antenna according to some embodiments of the present invention.

The invention will now be described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

It will be understood that, when an element is referred to as being "connected" to another element, it can be directly connected to the other element or intervening elements may be present. In contrast, when an element is referred to as being "directly connected" to another element, there are no intervening elements present. Like numbers refer to like elements throughout.

Spatially relative terms, such as "above", "below", "upper", "lower" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly. Well-known functions or constructions may not be described in detail for brevity and/or clarity.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of this specification and the relevant art and will not be interpreted in an idealized or overly formal sense expressly so defined herein.

Embodiments of the invention are described herein with reference to schematic illustrations of idealized embodiments of the invention. As such, variations from the shapes and relative sizes of the illustrations as a result, for example, of manufacturing techniques and/or tolerances, are to be expected. Thus, embodiments of the invention should not be construed as limited to the particular shapes and relative sizes of regions illustrated herein but are to include deviations in shapes and/or relative sizes that result, for example, from different operational constraints and/or from manufacturing constraints. Thus, the elements illustrated in the figures are schematic in nature and their shapes are not intended to illustrate the actual shape of a region of a device and are not intended to limit the scope of the invention.

For purposes of illustration and explanation only, various embodiments of the present invention are described herein in the context of a wireless communication terminal ("wireless terminal" or "terminal") that includes a MIMO antenna that is configured to transmit and receive RF signals in two or more frequency bands. The MIMO antenna may be configured, for example, to transmit/receive RF communication signals in the frequency ranges used for cellular communications (e.g., cellular voice and/or data communications), WLAN communications, and/or TransferJet communications, etc.

FIG. 1 illustrates an exemplary MIMO antenna 100 that is configured in accordance with some embodiments. Referring to FIG. 1, the MIMO antenna 100 includes at least two radiating elements. A first radiating element 110*a* includes a straight portion 114*a* connected to a serpentine-shaped portion 112*a*. The straight and serpentine portions 114*a*,112*a* are configured to resonate in at least two spaced apart RF frequency ranges in response to the straight portion being electrically excited through a first RF feed 116*a*. Similarly, a second radiating element 110*b* includes a straight portion 114*b* connected to a serpentine-shaped portion 112*b*. The straight and serpentine portions 114*b*,112*b* are configured to resonate in at least two spaced apart RF frequency ranges in response to the straight portion being electrically excited through a second RF feed 116*b*.

The first and second radiating elements 110*a*,110*b* may be formed on a planar substrate, such as on a conventional printed circuit board, which includes a dielectric material, ceramic material, or insulation material. The first and second radiating elements 110*a*,110*b* may be adjacent to a ground plane 140 on the printed circuit board. The first and second radiating elements 110*a*,110*b* may be formed by patterning a conductive (e.g., metallization) layer on a printed circuit board.

The MIMO antenna 100 may further include first and second parasitic radiating elements 120*a*, 120*b* that are configured to resonate at a high frequency RF band that can be different than that of the serpentine portions. The first parasitic radiating element 120*a* is adjacent and coupled to the first radiating element 110*a* and, in particular, to the straight portion 114*a* to radiate responsive to the straight portion 114*a* of the first radiating element 110*a* resonating at a RF frequency. Similarly, the second parasitic radiating element 120*b* is adjacent and coupled to the second radiating element 110*b* and, in particular, to the straight portion 114*b* to radiate responsive to the straight portion 114*b* of the second radiating element 110*b* resonating at a RF frequency. Accordingly, the first and second parasitic elements 120*a*,120*b* may provide a RF backscatter effect that may increase resonance within an operational RF frequency band and may, thereby, increase antenna efficiency and bandwidth of the first and second antenna elements 110*a*,110*b*. Moreover, the first and second parasitic elements 120*a*,120*b* can enable the antenna to have three or more RF bands of operation.

In some embodiments, the first and second radiating elements 110*a*,110*b* may be configured as a mirror image of each other, so that they have axial symmetry about a line equal distance between them. Accordingly, in some embodiments the straight portions 114*a*,114*b* of the first and second radiating elements can have equal conductive path lengths, and the serpentine portions 112*a*,112*b* can have equal conductive path lengths.

As shown in the exemplary embodiment of FIG. 1, the first and second radiating elements 110*a*,110*b* can be closely spaced. For example, the spacing between the first and second radiating elements 110*a*,110*b* may be less than the combined lengths of each of their straight portions 114*a*,114*b* and serpentine portions 112*a*,112*b*, and may be spaced much closer together with the spacing therebetween being less than the conductive length of each of the straight portions 114*a*,114*b*.

Closely spacing the first and second radiating elements 110*a*,110*b* can provide a more compact MIMO antenna structure and/or may simplify the transmitted and received circuitry that connects thereto. However, in many prior art MIMO antenna structures, radiating elements are necessarily spaced apart at much greater distances than what is shown in the exemplary embodiment of FIG. 1 in order to avoid undesirable cross coupling between the antenna elements, where RF signals transmitted by one antenna element induced undesirable interference currents in the adjacent antenna and vice versa.

In accordance with some embodiments, the first and second radiating elements 110*a*,110*b* are at least partially decoupled by interconnecting the first and second radiating elements 110*a*,110*b* through a conductive neutralization line 130 that conducts resonant currents therebetween to at least partially cancel RF transmission coupling between the first and second radiating elements 110*a*,110*b*. A conductive path length of the conductive neutralization line 130 can be configured to phase shift the conducted resonant currents to cause at least partial cancellation of RF signals wirelessly received by the first and second radiating elements from each other.

In some embodiments, the location which the conductive neutralization line 130 connects to the first and second radiating elements 110*a*,110*b* and the conductive path length of the conductive neutralization line 130 can be configured to phase shift the resonant current conducted from the first radiating element 110*a* to the second radiating element 110*b* to cause its subtraction from a current induced by a wireless RF signal received by the second radiating element 110*b* from the first radiating element 110*a*. The conductive neutralization line 130 can be further configured to similarly phase shift the resonant current conducted from the second radiating element 110*b* to the first radiating element 110*a* to cause its subtraction from a current induced by a wireless RF signal received by the first radiating element 110*a* from the second radiating element 110*b*. In this operational manner, cross-coupling of RF transmissions between the first and second radiating element 110*a*, 110*b* can be at least partially cancelled through the feed-forward cross-coupling of phase-shifted resonant currents therebetween that at least partially cancels the RF signals that the first and second radiating element 110*a*, 110*b* receive from each other.

The first and second radiating element 110*a*, 110*b* are configured to resonate in at least two RF frequency ranges. In some embodiments, a low band resonant frequency and one of the high band resonant frequencies are determined by the structure of their straight and serpentine portions. Another (third) resonant frequency is determined by the configuration of their respective parasitic radiating element 120*a-b*. The combined length of the straight and serpentine portions 114*a-b*,112*a-b* may be about a quarter wavelength of the low band resonant frequency. The length of the straight portions 114*a-b* can define one of the high band resonant frequencies due to a high impedance point being created close to a junction between the straight and serpentine portions. The high band RF signal is reflected by the high impedance point, resulting in the straight portions 114*a-b* action as high band radiators. The higher frequency range may, in some embodiments, be at least twice as great as frequencies within the lower RF frequency range. For example, the higher frequency range may include 5.2 GHz and the lower frequency range may include 2.4 GHz. In the exemplary embodiment of FIG. 1, the conductive length of the serpentine portion 112*a*,112*b* of the first and second radiating elements 110*a*,110*b* is at least four times greater than the conductive length of the respective straight portions 114*a*,114*b*.

The conductive neutralization line 130 may include at least at least two abrupt opposite direction changes (e.g., a directional switchback) along its conductive path to decrease distance between the first and second radiating elements 110*a*, 110*b*.

The size of the MIMO antenna 100 may be decreased by replacing a defined portion of the serpentine portions 112*a*, 112*b* with an inductive loaded antenna element. Regarding the first radiating element 110*a*, for example, an RF signal can enter RF feed 116*a* and flow through the straight portion 114*a*, a shortened serpentine portion 112*a*, and then through an inductive load element. The second radiating element 110*b* can be similarly or identically configured with a shortened serpentine portion 112*b* connected between the straight portion 114*b* and an inductive load element.

Figure 2:
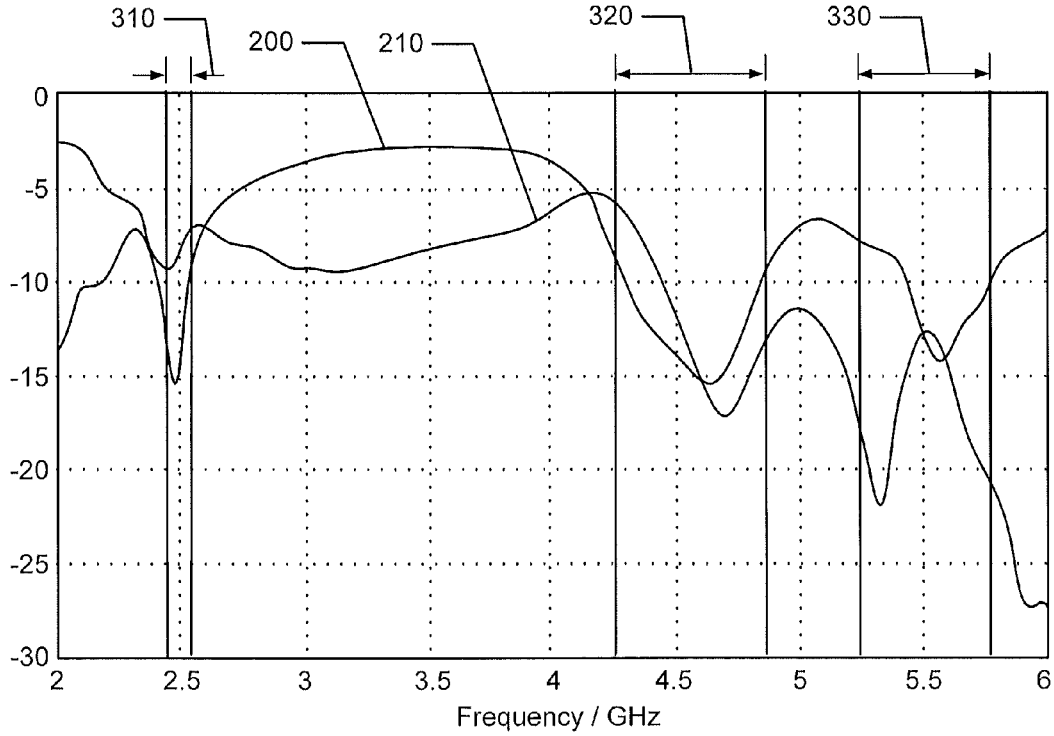
FIG. 2 graph of antenna scattering parameters ($S_{11}$, $S_{22}$ and $S_{21}$) versus frequency that may be generated by an operational simulation of the MIMO antenna of FIG. 1.

FIG. 2 graph of antenna scattering parameters ($S_{11}$, $S_{22}$ and $S_{21}$) versus frequency that may be generated by an operational simulation of the MIMO antenna of FIG. 1. $S_{11}$ and $S_{22}$ (collectively indicated by Curve 200 due to their symmetry causing overlapping curves) represent radiating elements 110*a* and 110*b*, respectively, and are measures of how much power (dB) is reflected back to transceiver circuitry connected thereto. $S_{21}$ (indicated by Curve 210) represents the coupling that occurs between the antenna feed ports of the radiating elements 110*a*,110*b*. Referring to FIG. 2, it is observed that significant decoupling is provided between the radiating elements 110*a*,110*b* within three commonly used frequency ranges: 1) a frequency range (illustrated as range 310) around 2.4 GHz, which is typically used by WLAN communication devices with MIMO antennas operating in the United States; 2) a frequency range (illustrated as range 320) around 4.5 GHz, which is typically used by Ultra Wide Band (UWB) and TransferJet communication devices; and 3) a frequency range (illustrated as range 330) around 5 GHz, which is typically used by WLAN communication devices with MIMO antennas operating in Europe.

Figure 3:
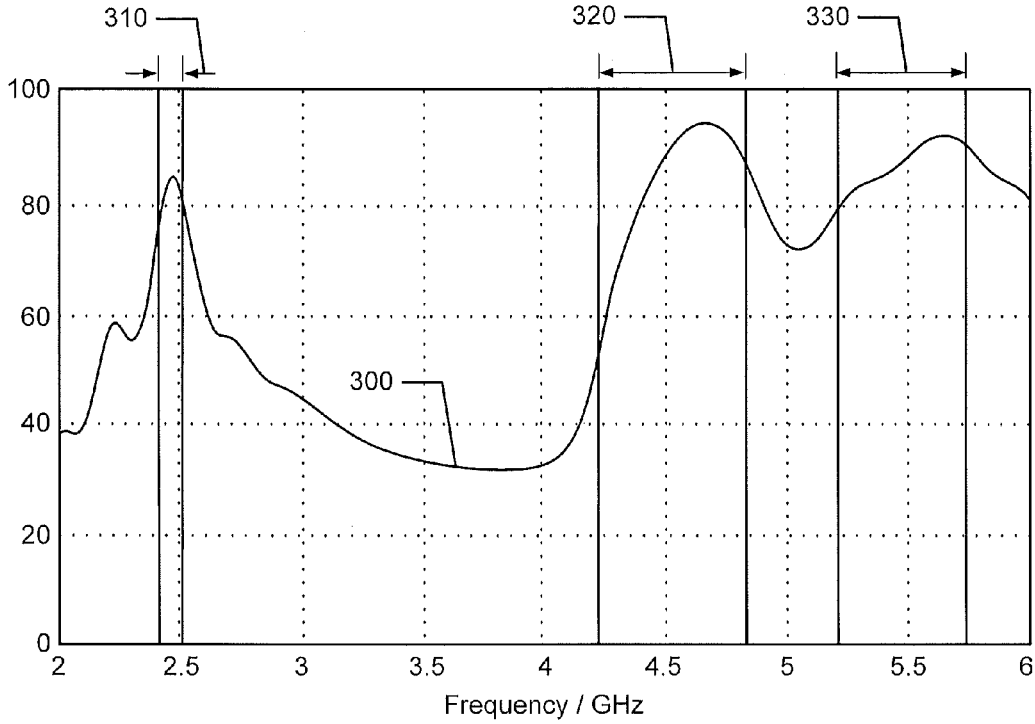
FIG. 3 is an exemplary graph of radiated power efficiency versus frequency that may be generated by an operational simulation of the MIMO antenna of FIG. 1.

FIG. 3 is an exemplary graph of radiated power efficiency versus frequency that may be generated by an operational simulation of the MIMO antenna of FIG. 1. Referring to FIG. 3, it is observed that the MIMO antenna 100 has good power efficiency in each of the frequency bands 310, 320, 330. Accordingly, although the first and second radiating elements 110*a*,110*b* are spaced close together, they maintain high radiating power efficiency because of the decoupling therebetween that is created by operation of the conductive neutralization line 130.

Figure 4:
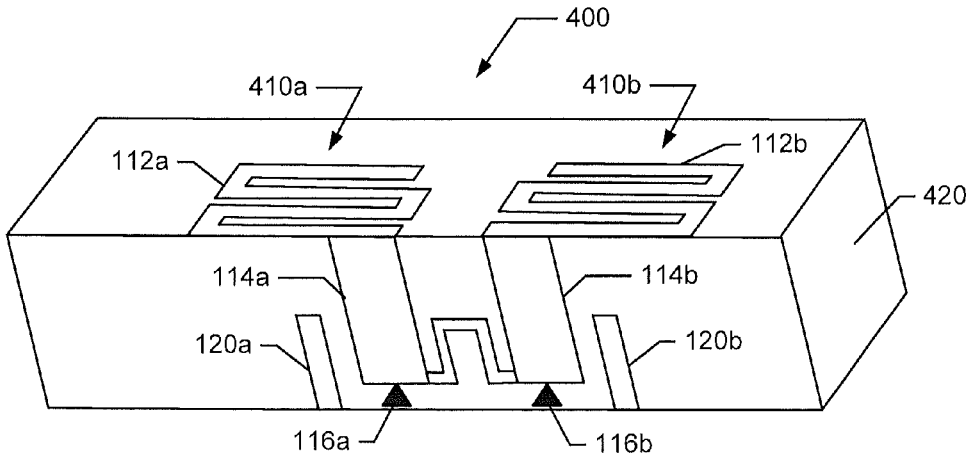
FIG. 4 is a plan view of a partial printed circuit board that includes a MIMO antenna according to some other embodiments of the present invention.

FIG. 4 is a plan view of a partial printed circuit board that includes a MIMO antenna 400 that is configured according to some other embodiments of the present invention. Referring to FIG. 4, the MIMO antenna 400 is similar to the MIMO antenna 100 of FIG. 1, with the first and second radiating elements 410*a*,410*b* each including a linear portion 114*a*, 114*b* connected to a respective serpentine-shape portion 112*a*,112*b*. However, in contrast to the MIMO antenna 100 of FIG. 1, in the MIMO antenna 400 of FIG. 4 the linear portions 114*a*,114*b* reside on a substrate 420 surface that is angled relative to another surface on which the serpentine portions 112*a*,112*b* reside. In the embodiment of FIG. 4, the linear portions 114*a*,114*b* lie in on a surface of the substrate 420 that is perpendicular to another surface of the substrate 420 on which the serpentine portions 112*a*,112*b* lie. The substrate 420 may be a conventional printed circuit board which includes a dielectric material, ceramic material, or insulation material.

The MIMO antenna 400 shown in FIG. 4 may provide a more compact structure that occupies less space and/or can reside in a smaller upper/lower/side portion of a communication device than the MIMO antenna 100 shown in FIG. 1.

Figure 5:
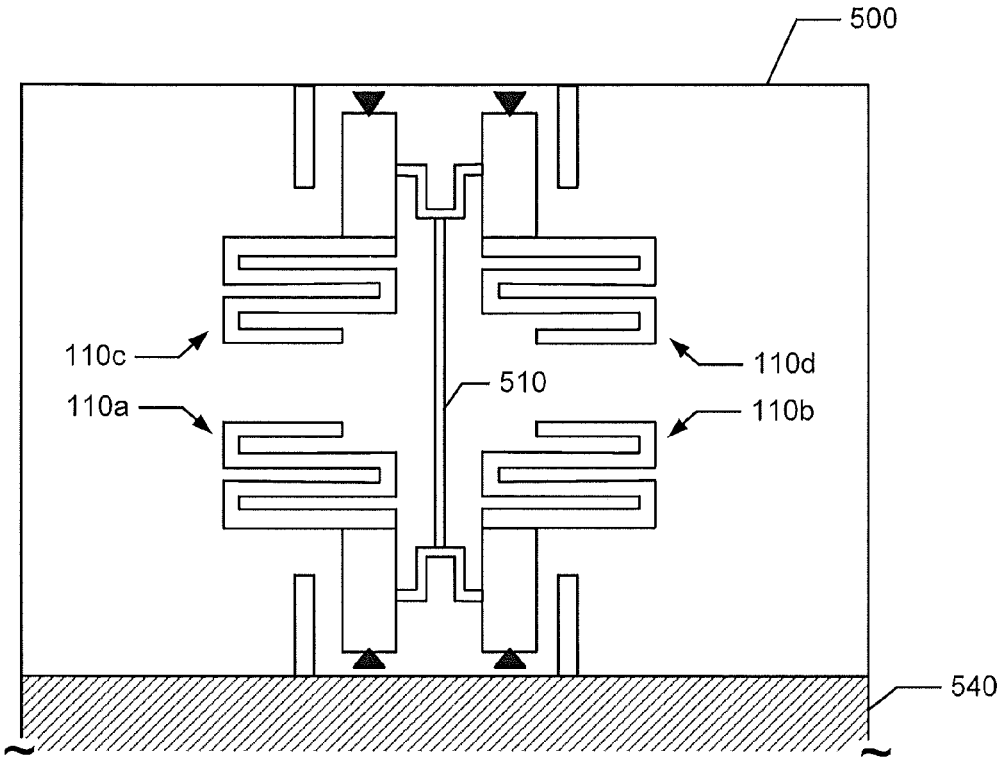
FIG. 5 is a plan view of a partial printed circuit board that includes a MIMO antenna with two pairs of the dual antenna elements shown in FIG. 1 according to some embodiments of the present invention.

FIG. 5 is a plan view of a partial printed circuit board that includes a MIMO antenna 500 that is configured in accordance with some embodiments of the present invention to include two pairs of the dual antenna elements shown in FIG. 1. Referring to FIG. 5, the structure of the MIMO antenna 100 of FIG. 1 has been duplicated and flipped to provide a MIMO antenna structure with four radiating elements. In particular, the MIMO antenna 500 includes first and second radiating elements 110*a*,110*b*, which may be identical to the same numbered features of FIG. 1, and third and fourth radiating elements 110*c*,110*d* which may be configured as a mirror image of the respective first and second radiating elements 110*a*,110*b* about an axis of symmetry that is about equal distance between those elements. Accordingly, the third and fourth radiating elements 110*c*,110*d* can each include a straight portion that is connected between the RF feed and a serpentine-shape portion.

A conductive neutralization line 510 interconnects the conductive neutralization lines 130 between the first and second radiating elements 110*a*,110*b* and between the third and fourth radiating elements 110*c*,110*d*. A conductive path length of the conductive neutralization line 510 can be configured to phase shift the conducted resonant currents to cause at least partial cancellation of RF signals wirelessly received by the third radiating element 110*c* from the first radiating element 110*a*, to cause at least partial cancellation of RF signals wirelessly received by the first radiating element 110*a* from the third radiating element 110*c*, to cause at least partial cancellation of RF signals wirelessly received by the fourth radiating element 110*d* from the second radiating element 110*b*, and to cause at least partial cancellation of RF signals wirelessly received by the second radiating element 110*b* from the fourth radiating element 110*d*. The conductive neutralization line 510 may include abrupt directional changes, such as shown for the conductive neutralization line 130 in FIG. 1, to decrease distance between the radiating elements.

Figure 6:
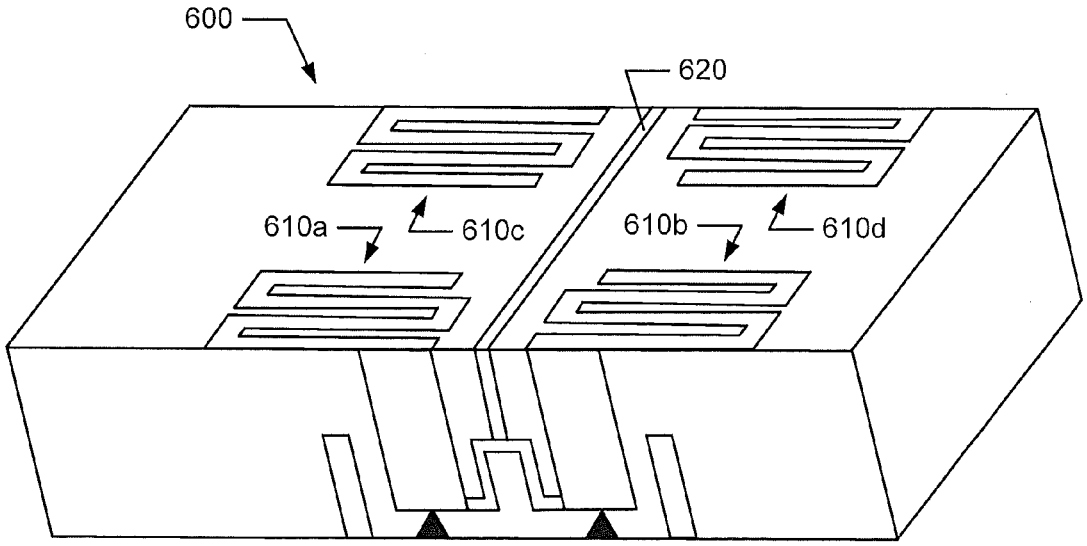
FIG. 6 is a plan view of a partial printed circuit board that includes a MIMO antenna with two pairs of the dual antenna elements shown in FIG. 4 according to some embodiments of the present invention.

FIG. 6 is a plan view of a partial printed circuit board that includes a MIMO antenna 600 with two pairs of the dual antenna elements shown in FIG. 4 according to some embodiments of the present invention. Referring to FIG. 6, the structure of the MIMO antenna 400 of FIG. 4 has been duplicated and flipped to provide a MIMO antenna structure with four radiating elements. In particular, the MIMO antenna 600 includes first and second radiating elements 410*a*,410*b*, which may be identical to the same numbered features of FIG. 4, and third and fourth radiating elements 410*c*,410*d* which may be configured as a mirror image of the respective first and second radiating elements 410*a*,410*b* about an axis of symmetry that is about equal distance between those elements. Accordingly, the third and fourth radiating elements 410*c*, 410*d* can each include a straight portion that is connected between the RF feed and a serpentine-shape portion.

The straight portions of the first, second, third, and fourth radiating elements 410*a*,410*b*,410*c*,410*d* may reside on a same planar substrate surface. The serpentine portions of the first and second radiating elements 410*a*,410*b* may reside on a substrate surface that is perpendicular (or angled at another angle) to the substrate surface on which the straight portions lie. Similarly, the serpentine portions of the third and fourth radiating elements 410*c*,410*d* may reside on a substrate surface that is perpendicular (or angled at another angle) to the substrate surface on which the straight portions lie, and that substrate surface may be parallel to the substrate surface on which the serpentine portions of the first and second radiating elements 410*a*,410*b* lie.

A conductive neutralization line 620 interconnects the conductive neutralization lines 130 between the first and second radiating elements 410*a*,410*b* and between the third and fourth radiating elements 410*c*,410*d*. A conductive path length of the conductive neutralization line 620 can be configured to phase shift the conducted resonant currents to cause at least partial cancellation of RF signals wirelessly received by the third radiating element 410*c* from the first radiating element 410*a*, to cause at least partial cancellation of RF signals wirelessly received by the first radiating element 410*a* from the third radiating element 410*c*, to cause at least partial cancellation of RF signals wirelessly received by the fourth radiating element 410*d* from the second radiating element 410*b*, and to cause at least partial cancellation of RF signals wirelessly received by the second radiating element 410*b* from the fourth radiating element 410*d*. The conductive neutralization line 510 may include abrupt directional changes, such as shown for the conductive neutralization line 130 in FIG. 1, to decrease distance between the radiating elements.

Figure 7:
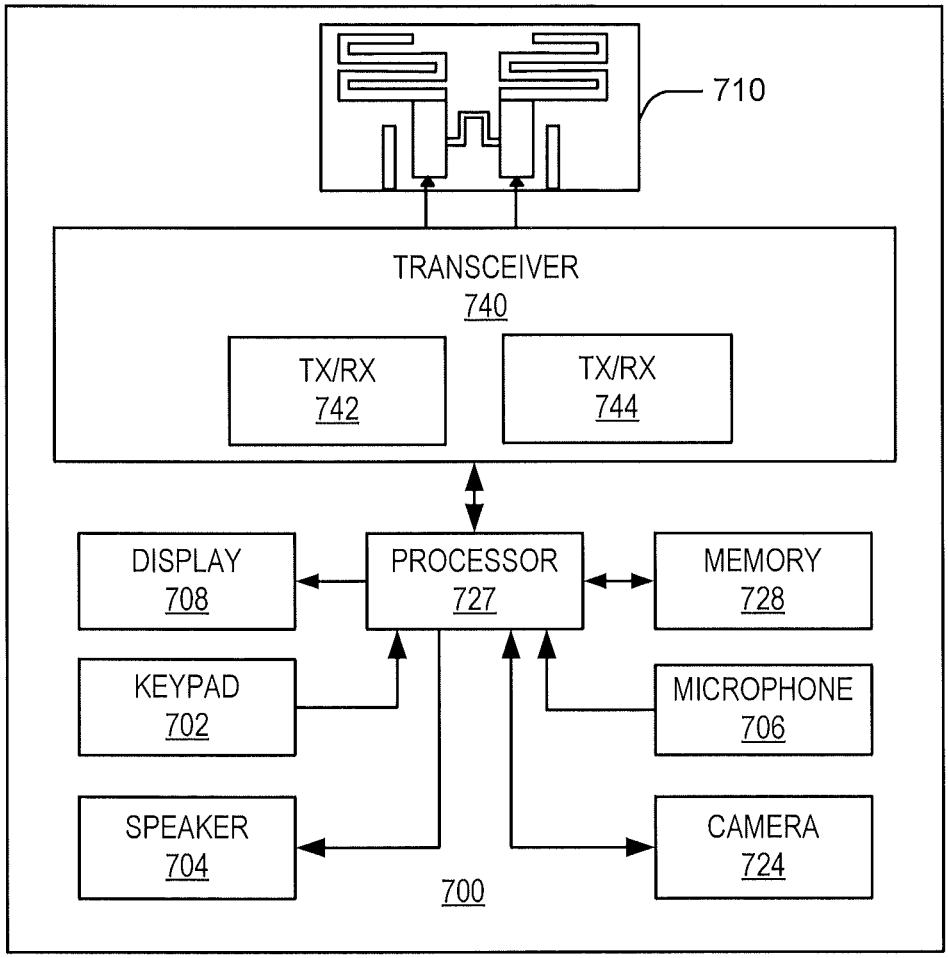
FIG. 7 is a block diagram of some electronic components, including a MIMO antenna, of a wireless communication terminal in accordance with some embodiments of the present invention.

FIG. 7 is a block diagram of a wireless communication terminal 700 that includes a MIMO antenna in accordance with some embodiments of the present invention. Referring to FIG. 7, the terminal 700 includes a MIMO antenna 710, a transceiver 740, a processor 727, and can further include a conventional display 708, keypad 702, speaker 704, mass memory 728, microphone 706, and/or camera 724, one or more of which may be electrically grounded to the same ground plane (e.g., ground plane 140 in FIG. 1) as the MIMO antenna 710. The MIMO antenna 710 may be structurally configured as shown for MIMO antenna 100 of FIG. 1, MIMO antenna 400 of FIG. 4, MIMO antenna 500 of FIG. 5, MIMO antenna 600 FIG. 6, or may be configured in accordance with various other embodiments of the present invention.

The transceiver 740 may include transmit/receive circuitry (TX/RX) that provides separate communication paths for supplying/receiving RF signals to different radiating elements of the MIMO antenna 710 via their respective RF feeds. Accordingly, when the MIMO antenna 710 includes two antenna elements, such as shown in FIG. 1, the transceiver 740 may include two transmit/receive circuits 742,744 connected to different ones of the antenna elements via the respective RF feeds 116*a* and 116*b*.

The transceiver 740 in operational cooperation with the processor 727 may be configured to communicate according to at least one radio access technology in two or more frequency ranges. The at least one radio access technology may include, but is not limited to, WLAN (e.g., 802.11), WiMAX (Worldwide Interoperability for Microwave Access), TransferJet, 3GPP LTE (3rd Generation Partnership Project Long Term Evolution), Universal Mobile Telecommunications System (UMTS), Global Standard for Mobile (GSM) communication, General Packet Radio Service (GPRS), enhanced data rates for GSM evolution (EDGE), DCS, PDC, PCS, code division multiple access (CDMA), wideband-CDMA, and/or CDMA2000. Other radio access technologies and/or frequency bands can also be used in embodiments according to the invention.

It will be appreciated that certain characteristics of the components of the MIMO antennas shown in FIGS. 1, 4, 5, 6, and 7 such as, for example, the relative widths, conductive lengths, and/or shapes of the radiating elements, the conductive neutralization lines, and/or other elements of the MIMO antennas may vary within the scope of the present invention. Thus, many variations and modifications can be made to the embodiments without substantially departing from the principles of the present invention. All such variations and modifications are intended to be included herein within the scope of the present invention, as set forth in the following claims.

What is claimed is:

1. A MIMO antenna comprising:

a first radiating element that includes a straight portion connected to a serpentine portion, wherein the straight and serpentine portions are configured to resonate in at least two spaced apart RF frequency ranges in response to the straight portion being electrically excited through a first RF feed, and wherein the straight portion of the first radiating element separates the first RF feed from the serpentine portion thereof;

a second radiating element that includes a straight portion connected to a serpentine portion, wherein the straight and serpentine portions are configured to resonate in at least two spaced apart RF frequency ranges in response to the straight portion being electrically excited through a second RF feed, and wherein the straight portion of the second radiating element separates the second RF feed from the serpentine portion thereof;

a conductive neutralization line that connects the first and second radiating elements to conduct resonant currents therebetween that at least partially cancel RF transmission coupling between the first and second radiating elements;

a third radiating element that includes a straight portion connected to a serpentine portion, wherein the straight and serpentine portions are configured to resonate within at least two spaced apart RF frequency ranges in response to the straight portion being electrically excited through a third RF feed;

a fourth radiating element that includes a straight portion connected to a serpentine portion, wherein the straight and serpentine portions are configured to resonate within at least two spaced apart RF frequency ranges in response to the straight portion being electrically excited through a fourth RF feed;

another conductive neutralization line that connects the third and fourth radiating elements; and an interconnection conductive neutralization line that connects the conductive neutralization line to the other conductive neutralization line to at least partially cancel RF transmission coupling between the first, second, third, and fourth radiating elements, wherein the straight portions of the first, second, third, and fourth radiating elements lie in a plane that is perpendicular to another plane in which the serpentine portions of the first, second, third, and fourth radiating elements lie.

2. The MIMO antenna of claim 1, wherein:

the straight portions of the first and second radiating elements have an equal conductive path length; and the serpentine portions of the first and second radiating elements have an equal conductive path length.

3. The MIMO antenna of claim 2, wherein:

the straight and serpentine portions of the second radiating element are configured as a mirror image of the straight and serpentine portions of the first radiating element.

4. The MIMO antenna of claim 1, wherein:

a conductive path length of the conductive neutralization line is configured to phase shift the conducted resonant currents to cause at least partial cancellation of RF signals wirelessly received by the first and second radiating elements from each other.

5. The MIMO antenna of claim 4, wherein:

the location of connection of the conductive neutralization line to the first and second radiating elements and the conductive path length of the conductive neutralization line are configured to phase shift the resonant current conducted from the first radiating element to the second radiating element to cause its subtraction from a current induced by a wireless RF signal received by the second radiating element from the first radiating element, and configured to phase shift the resonant current conducted from the second radiating element to the first radiating element to cause its subtraction from a current induced by a wireless RF signal received by the first radiating element from the second radiating element.

6. The MIMO antenna of claim 1, wherein:

the first and second radiating elements are spaced apart by less than the combined conductive lengths of the straight and serpentine portions of the first radiating element.

7. The MIMO antenna of claim 6, wherein:

the first and second radiating elements are spaced apart by less than the conductive length of the straight portion of the first radiating element.

8. The MIMO antenna of claim 1, wherein:

the first radiating element is configured to resonate within a lower RF frequency range defined by a combined conductive length of its straight and serpentine portions, and to resonate within a higher RF frequency range defined by a conductive length of its straight portion.

9. The MIMO antenna of claim 1, wherein:

the first and second radiating elements are each configured to resonate within higher and lower RF frequency ranges, the higher frequency range including a frequency at least twice as great as frequencies within the lower RF frequency range.

10. The MIMO antenna of claim 9, wherein the higher frequency range includes 5.2 GHz and the lower frequency range includes 2.4 GHz.

11. The MIMO antenna of claim 1, wherein:

the conductive neutralization line includes at least two abrupt opposite direction changes along its conductive path to decrease distance between the first and second radiating elements.

12. The MIMO antenna of claim 1, wherein:

a conductive length of the serpentine portion of each of the first and second radiating elements is at least four times greater than a respective conductive length of the straight portion of the first and second radiating elements.

13. The MIMO antenna of claim 1, wherein:

the first and second radiating elements each include an inductive load element that is connected to a distal end of the serpentine portion from an end connected to the straight portion.

14. The MIMO antenna of claim 1, further comprising:

a planar substrate comprising the straight portions of the first and second radiating elements, respectively, thereon;

a first parasitic radiating element that is on the planar substrate and is adjacent and parasitically coupled to the first radiating element to radiate responsive to the first radiating element resonating at a RF frequency;

a second parasitic radiating element that is physically isolated from the first parasitic radiating element on the planar substrate and is adjacent and parasitically coupled to the second radiating element to radiate responsive to the second radiating element resonating at a RF frequency, wherein the first and second parasitic radiating elements are on a same side of the planar substrate as the straight portions of the first and second radiating elements, and wherein the first and second parasitic radiating elements are configured to provide a third RF frequency range for the MIMO antenna.

15. The MIMO antenna of claim 1, wherein:

the straight portions of the first and second radiating elements lie on a planar substrate surface is perpendicular to another planar substrate surface on which the serpentine portions of the first and second radiating elements lie.

16. The MIMO antenna of claim 1, wherein:

the straight and serpentine portions of the first and second radiating elements are on a planar substrate.

17. A MIMO antenna comprising:

a first radiating element that includes a straight portion connected to a serpentine portion, wherein the straight and serpentine portions are configured to resonate in at least two spaced apart RF frequency ranges in response to the straight portion being electrically excited through a first RF feed, and wherein the straight portion of the first radiating element separates the first RF feed from the serpentine portion thereof;

a second radiating element that includes a straight portion connected to a serpentine portion, wherein the straight and serpentine portions are configured to resonate in at least two spaced apart RF frequency ranges in response to the straight portion being electrically excited through a second RF feed, and wherein the straight portion of the second radiating element separates the second RF feed from the serpentine portion thereof;

a conductive neutralization line that is configured to conduct resonant currents between the first and second radiating elements and has a conductive length that is configured to phase shift the conducted resonant currents to cause at least partial cancellation of currents in the first and second radiating elements which are generated by wireless RF signals received by the first and second radiating elements from each other, wherein first and second ends of the conductive neutralization line directly connect to the first and second radiating elements, respectively;

a first parasitic radiating element that is adjacent and parasitically coupled to the first radiating element to radiate responsive to the first radiating element resonating at a RF frequency; and a second parasitic radiating element that is adjacent and parasitically coupled to the second radiating element to radiate responsive to the second radiating element resonating at a RF frequency;

a third radiating element that includes a straight portion connected to a serpentine portion, wherein the straight and serpentine portions are configured to resonate within at least two spaced apart RF frequency ranges in response to the straight portion being electrically excited through a third RF feed;

a fourth radiating element that includes a straight portion connected to a serpentine portion, wherein the straight and serpentine portions are configured to resonate within at least two spaced apart RF frequency ranges in response to the straight portion being electrically excited through a fourth RF feed;

another conductive neutralization line that connects the third and fourth radiating elements; and an interconnection conductive neutralization line that connects the conductive neutralization line to the other conductive neutralization line to at least partially cancel RF transmission coupling between the first, second, third, and fourth radiating elements, wherein the straight portions of the first, second, third, and fourth radiating elements lie in a plane that is perpendicular to another plane in which the serpentine portions of the first, second, third, and fourth radiating elements lie.

18. The MIMO antenna of claim 17, wherein the first and second ends of the conductive neutralization line directly connect to respective ones of the straight portions of the first and second radiating elements.

19. The MIMO antenna of claim 1, wherein:

the straight portion of the first radiating element comprises a first width substantially wider than a second width of the serpentine portion of the first radiating element; and the straight portion of the second radiating element comprises a third width substantially wider than a fourth width of the serpentine portion of the second radiating element.

* * * * *